US009694960B2

(12) United States Patent
Conners et al.

(10) Patent No.: US 9,694,960 B2
(45) Date of Patent: Jul. 4, 2017

(54) FLEXIBLE PACKAGES HAVING CONCEALED GRAPHICS PANEL

(71) Applicants: Sheena E. Conners, Neenah, WI (US); Ellen M. Krabbe, New London, WI (US)

(72) Inventors: Sheena E. Conners, Neenah, WI (US); Ellen M. Krabbe, New London, WI (US)

(73) Assignee: Bemis Company, Inc., Neenah, WI (US)

( * ) Notice: Subject to any disclaimer, the term of this patent is extended or adjusted under 35 U.S.C. 154(b) by 31 days.

(21) Appl. No.: 14/725,737

(22) Filed: May 29, 2015

(65) Prior Publication Data

US 2016/0347523 A1 Dec. 1, 2016

(51) Int. Cl.
*B65D 75/44* (2006.01)

(52) U.S. Cl.
CPC ..... *B65D 75/44* (2013.01); *B31B 2219/2681* (2013.01); *B31B 2219/6053* (2013.01); *B31B 2219/88* (2013.01); *B65D 2203/00* (2013.01)

(58) Field of Classification Search
CPC ..... B31B 1/88; B31B 2201/88; B65D 5/4212; B65D 5/425; B65D 33/20; B65D 75/12; B65D 75/28; B65D 75/52; B65D 85/00; B65D 33/16; B65D 33/30
USPC ..... 206/459.5
See application file for complete search history.

(56) References Cited

U.S. PATENT DOCUMENTS

| | | | | |
|---|---|---|---|---|
| 3,285,497 | A * | 11/1966 | Stillman | B65D 75/28 206/459.5 |
| 4,709,396 | A | 11/1987 | Voshall et al. | |
| 5,103,979 | A | 4/1992 | Hustad | |
| 6,641,306 | B1 | 11/2003 | Knoerzer et al. | |
| 6,679,630 | B2 | 1/2004 | Knoerzer et al. | |
| 6,682,469 | B1 | 1/2004 | Knoerzer | |
| 7,686,513 | B2 * | 3/2010 | Knoerzer | B65D 31/02 383/111 |
| 8,573,396 | B2 | 11/2013 | Brownell | |
| 8,794,834 | B2 * | 8/2014 | Forman | B65D 33/20 383/2 |
| 2003/0223653 | A1 | 12/2003 | Knoerzer et al. | |
| 2014/0301676 | A1 * | 10/2014 | Forman | B65D 33/20 383/211 |

FOREIGN PATENT DOCUMENTS

WO 2005080220 A1 1/2005

* cited by examiner

*Primary Examiner* — Bryon Gehman
(74) *Attorney, Agent, or Firm* — Lynn M. Nett

(57) ABSTRACT

A flexible package includes a seal region and a concealed graphics panel. The seal region includes an unsealed area disposed between a first seal portion and a second seal portion. The concealed graphics panel is located substantially within the unsealed area of the seal region where it is not visible until the flexible package is opened. The configuration of the seal region and related location of the concealed graphics panel provides for a concealed graphics panel space that is separate from the product storage space at least when the flexible package is closed. The flexible package may be formed from simple film structures.

18 Claims, 9 Drawing Sheets

FLEXIBLE PACKAGES HAVING CONCEALED GRAPHICS PANEL

BACKGROUND

The present disclosure relates generally to the field of packages. More specifically, the present disclosure relates to the field of flexible packages for which inclusion of promotional information may be desirable.

SUMMARY

An exemplary embodiment relates to a flexible package comprising a film having a first side generally opposite a second side; a package interior including a product storage space; an overlapped region of the film; a longitudinal heat seal region generally corresponding to the overlapped region of the film; an unsealed area of the longitudinal heat seal region disposed between a first heat seal and a second heat seal; an ink layer disposed on the first side of the film; an exterior graphics panel of the ink layer generally corresponding to an exterior package surface; and a concealed graphics panel of the ink layer disposed within the package interior and substantially within the unsealed area of the longitudinal heat seal region.

Another exemplary embodiment relates to a flexible package, comprising a film having a first side generally opposite a second side; a package interior including a product storage space; a seal region including an unsealed area disposed between a first seal portion and a second seal portion; an exterior graphics panel generally corresponding to an exterior package surface; and a concealed graphics panel located substantially within the unsealed area of the seal region.

Yet another exemplary embodiment relates to a method of making a flexible package having a concealed graphics space, the method comprising providing a film having a first side generally opposite a second side; applying an ink layer to the film, the ink layer including a concealed graphics panel; forming the film into a tube; and creating a seal region, wherein the heat seal region includes an unsealed area disposed between a first seal portion and a second seal portion; wherein the concealed graphics panel is located within the unsealed area of the seal region.

DETAILED DESCRIPTION

Referring generally to the FIGURES, disclosed herein are flexible packages including a graphics panel that is concealed (e.g., not visible) when the flexible package is in a closed position (i.e., before the flexible package is opened (e.g., by a consumer to access product therein)). Having a graphics panel that is concealed provides an opportunity to include promotional information (e.g., coupons, sweepstakes information, etc.) or other information that may be desirably concealed prior to opening the package (hereafter, collectively referred to as promotional information).

Hidden graphics are generally known in the art, having commonly been added to the package using labels or stickers. Coupons have also been integrated into a multilayer film structure, requiring more complex film structures.

The flexible packages of this disclosure are capable of being formed from very simple film structures, including 2-layer films and even 1-layer films. This is particularly beneficial for applications where complex film structures are not already required for adequate protection of the product stored within the package (e.g., snack foods, fishing lures, candy, etc.). More complex film structures are generally more expensive and more complicated to work with than simpler film structures. Moreover, complex film structures may require modifications to the packaging structure, modifications or changes to the machinery on which the package is formed, or adaptations to the process by which the package is formed. Thus, changing from a simpler film structure to a more complex structure typically results in increased manufacturing expense and time.

Another desirable feature of the flexible packages of this disclosure is the separation of the concealed graphics panel from the product storage space of the package. This is particularly desirable for many food packaging applications for which minimizing contact or exposure of a food product to ink may be not only desirable but also regulated.

Finally, the flexible packages of this disclosure do not require separate inserts for the promotional information. Rather, the graphics panel that is concealed is integral with the package itself; that is, it is integrated by applying an ink layer to the film used to form the package. Packages requiring inserts for promotional information often require additional manufacturing steps and generally have increased manufacturing expense.

Figure 1:
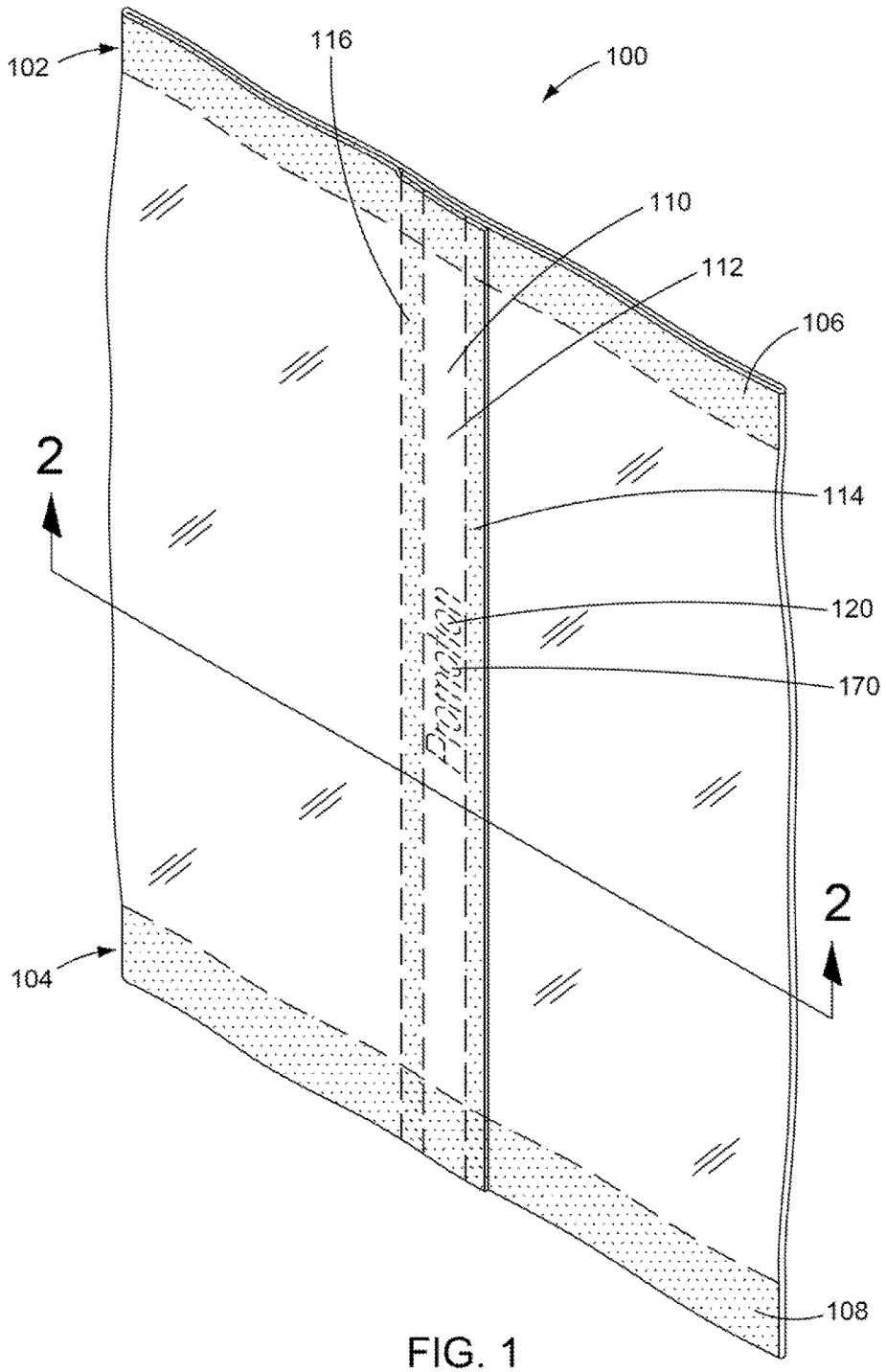
FIG. 1 is a back perspective view of a flexible package including a concealed graphics panel in a closed position according to an exemplary embodiment.

FIG. 1 illustrates an exemplary embodiment of a flexible package 100 in a closed position. The flexible package 100 includes a seal region 110 and a concealed graphics panel 120. The seal region 110 includes an unsealed area 112 disposed between a first seal portion shown as a first seal 114 and a second seal portion shown as a second seal 116. The concealed graphics panel 120 is located within the unsealed area 112 of the seal region 110 where it is not visible (e.g., to a consumer) until the flexible package 100 is opened. Significantly, the configuration of the seal region 110 and related location of the concealed graphics panel 120 provides for a concealed graphics panel space 122 (e.g., compartment, chamber, cavity, pocket, etc.) that is separate from the product storage space 130 of a package interior 140 (see, e.g., FIG. 2). In this way, product stored (e.g., contained, disposed in, etc.) the product storage space 130 is separated from the concealed graphics panel 120 and the ink used to create it. It should be appreciated that the concealed graphics panel may occupy the unsealed area in whole or in part.

Figure 2:
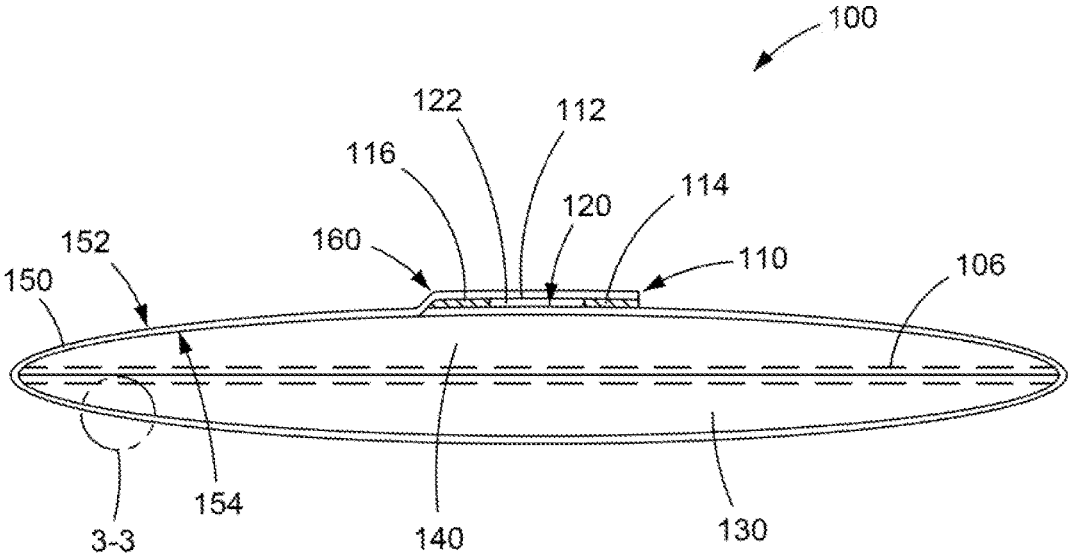
FIG. 2 is a cross-sectional view of the flexible package of FIG. 1 taken along line 2-2 according to an exemplary embodiment.
Figure 3:
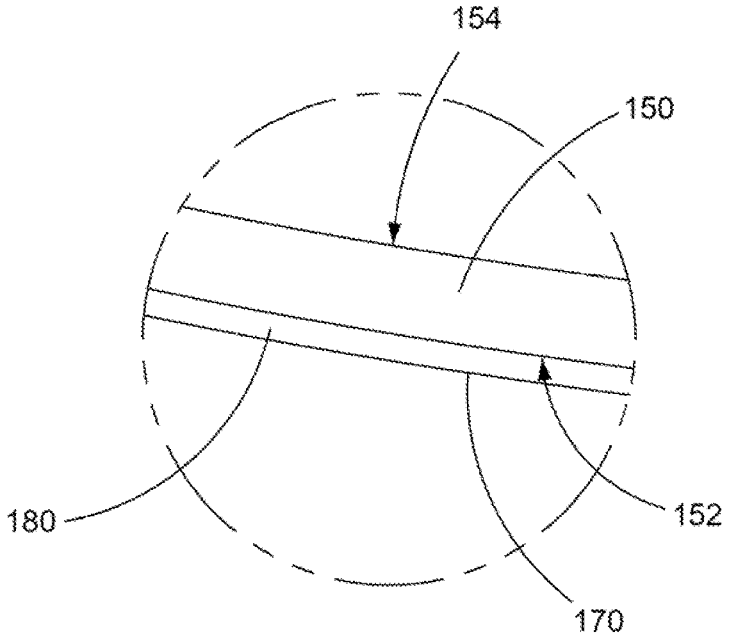
FIG. 3 is a detail view of the cross-sectional view of FIG. 2 taken along line 3-3 according to an exemplary embodiment.

Referring to FIGS. 1-3, the seal region 110 is (e.g., collectively functions as) a longitudinal seal that is shown as a back lap seal type longitudinal seal and further shown generally corresponding to an overlapped region 160 of a film 150 used to form the flexible package 100 according to an exemplary embodiment. An ink layer 170 is shown disposed on a first side 152 of the film 150 generally opposite a second side 154 of the film 150. The second side 154 of the film 150 is shown as the sealant side (or layer, depending on the film structure) of the film and generally corresponding to the package interior 140. The ink layer 170 on the first side 152 of the film 150 includes the concealed graphics panel 120 as well as an exterior graphics panel 180 (specific ink design not shown) that generally corresponds to the exterior surface of the flexible package 100 (in the closed position). Utilizing only a single ink layer to create both the exterior graphics panel and the concealed graphics panel is particularly desirable because it provides for a more streamlined process for manufacturing the flexible package 100.

As is clear from FIG. 2, the concealed graphics panel 120 is not only separate from the product storage space 130, but also is itself within a package interior 140 of the flexible package 100 in the present exemplary embodiment. Thus, in addition to the benefit of separating the ink of the concealed graphics panel 120 from product in the product storage space 130, the concealed graphics panel 120 (and thereby, any promotional information it may contain) is beneficially not accessible without opening the package 100. This configuration thus reduces the risk that the promotional information may be accessed and utilized without purchase of the product.

Referring to FIGS. 2-3, within the concealed graphics panel space 122, the concealed graphics panel 120 is shown facing the second side 154 of the film 150 and toward the exterior of the flexible package 100. While the concealed graphics panel space 122 is shown somewhat exaggerated for clarity, it should be understood that the concealed graphics panel 120 may be generally adjacent to (e.g., in contact with) the second side 154 of the film 150 when the package 100 is in the closed position.

Figure 4:
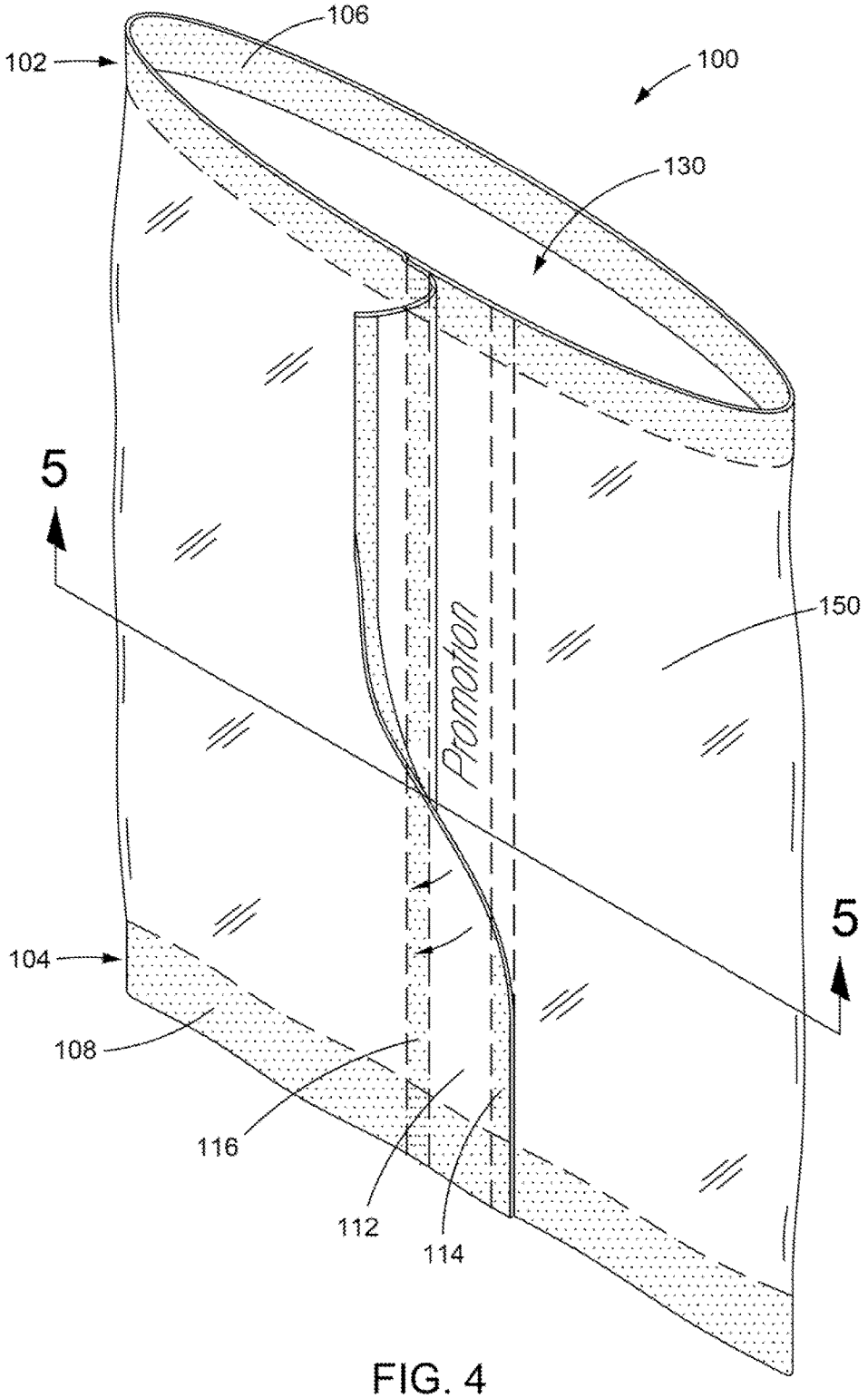
FIG. 4 is a back perspective view of the flexible package of FIG. 1 in an open position according to an exemplary embodiment.
Figure 5:
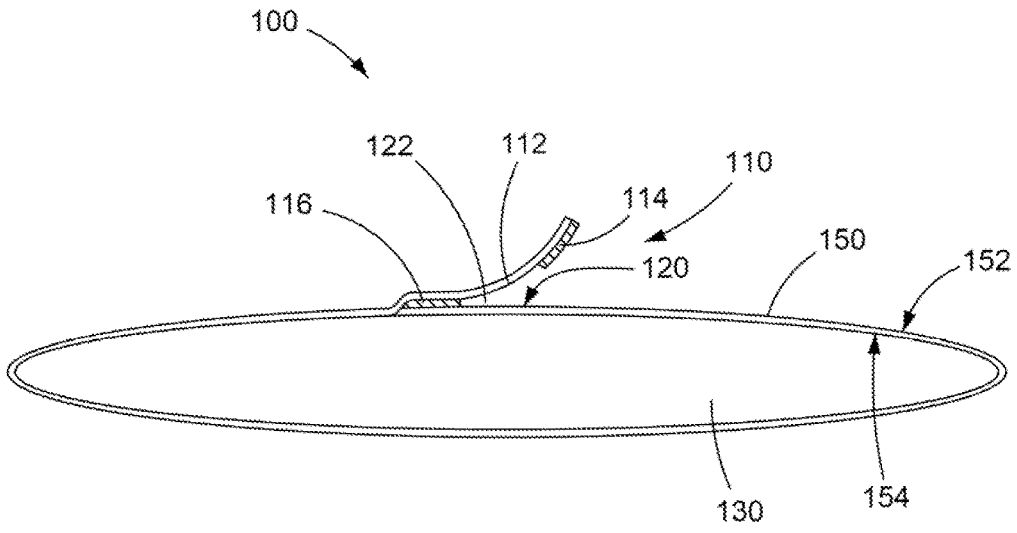
FIG. 5 is cross-sectional view of the flexible package of FIG. 4 taken along line 5-5.

FIG. 4 and FIG. 5 show the package 100 in an open position with the concealed graphics panel 120 exposed (e.g., accessed, opened, visible, etc.) according to an exemplary embodiment. A first end 102 of the package 100 generally opposite a second end 104 of the package 100 has been opened by breaking (e.g., rupturing, separating, tearing, peeling, etc.) a transverse seal 106 at the first end 102.

Breaking the transverse seal 106 at the first end 102 of the package 100 helps provide access to both the product storage space 130 and the concealed graphics panel space 122 according to an exemplary embodiment. Breaking the transverse seal 106 at the first end 102 results in an initial break or weakening of the first seal 114 proximate the first end 102. This initial break or weakening can be extended and/or exploited to further access the unsealed area 112, reveal the concealed graphic panel 120, and view the promotional information. As shown in FIG. 4, as the initial break of first seal 114 is exploited (e.g., by further breaking, tearing along the seal, cutting, pulling, etc.), the resultant flap of film 150 from the overlap region 160 can be lifted (i.e., away from the package exterior) to better view the promotional information. The arrows shown in FIG. 4 indicate application of a pulling force utilized to help exploit the initial break of the first seal/access the promotional information. Other suitable methods of exploiting the initial break and/or accessing the promotional information may include application of opposing pulling forces similar to that used to open the package, etc.

As would be readily appreciated by one of skill in the art, the seal portions may be configured (e.g., size, strength, shape, etc.) to help achieve a desirable manner of accessing the concealed graphics panel/viewing the promotional information. For instance, while the first seal 114 and second seal 116 are shown to be generally the same size and shape, the first seal could have a width less than the width of the second seal to help ensure the first seal breaks more readily than the second seal. Moreover, such a configuration may make it easier to extend the initial breaking or weakening of the first seal to more fully reveal the promotional information. One of skill in the art would also appreciate that materials selection and heat seal temperatures can provide heat seal characteristics desirable for exposing the concealed graphics panel 120.

According to another exemplary embodiment, the promotional information is accessed by cutting (e.g., using scissors) into the concealed graphics space. In some exemplary embodiments, the package may include printed instructions or other indicator to cut (e.g., a "cut here" symbol).

According to another exemplary embodiment, the flexible package may further include a pull tab or other similar feature facilitating application of a pulling force providing for accessing the promotional information.

According to another exemplary embodiment, the flexible package may further include a structural weakness (e.g., perforations, holes, score lines, laser score lines, tear lines, tear strips, cut patterns, microperforations, etc.) to facilitate opening the package and accessing the promotional information. It should be noted that opening the package may include removal of at least a portion of the package (e.g., the first end of the package, a corner of the package, etc.).

According to another exemplary embodiment, the first seal is a peelable seal (e.g., utilizing a peelable sealant layer, a peelable adhesive, etc.). Formation of a peelable heat seal may be accomplished, for example, by methods disclosed in U.S. Pat. No. 4,944,409, which is hereby incorporated by reference.

While the first seal 114 is shown breaking to reveal the concealed graphics panel 120 in the present exemplary embodiment, it is contemplated that the second seal 116 could be broken to reveal the concealed graphics panel. In this case, the first seal 114 remains essentially (or more so) intact while the second seal 116 is ruptured. The resultant flap is pulled generally inward, toward the product storage space 130 to expose (e.g., reveal, view, etc.) the concealed graphics panel 120. Thus, the unsealed area 112 is accessed substantially from the interior of the package, rather from the exterior of the package as shown in FIGS. 3 and 4. While possible, accessing the product from the interior of the package is, in most circumstances, considered less desirable as the product may be exposed to the ink (though, for a limited time) and the promotional information is more challenging to read/see. According to other exemplary embodiments, a reverse printed film structure (e.g., such as one discussed in more detail below) or application of a protective varnish over the printing can be used, thereby preventing ink exposure for even a limited time.

Figure 6A:
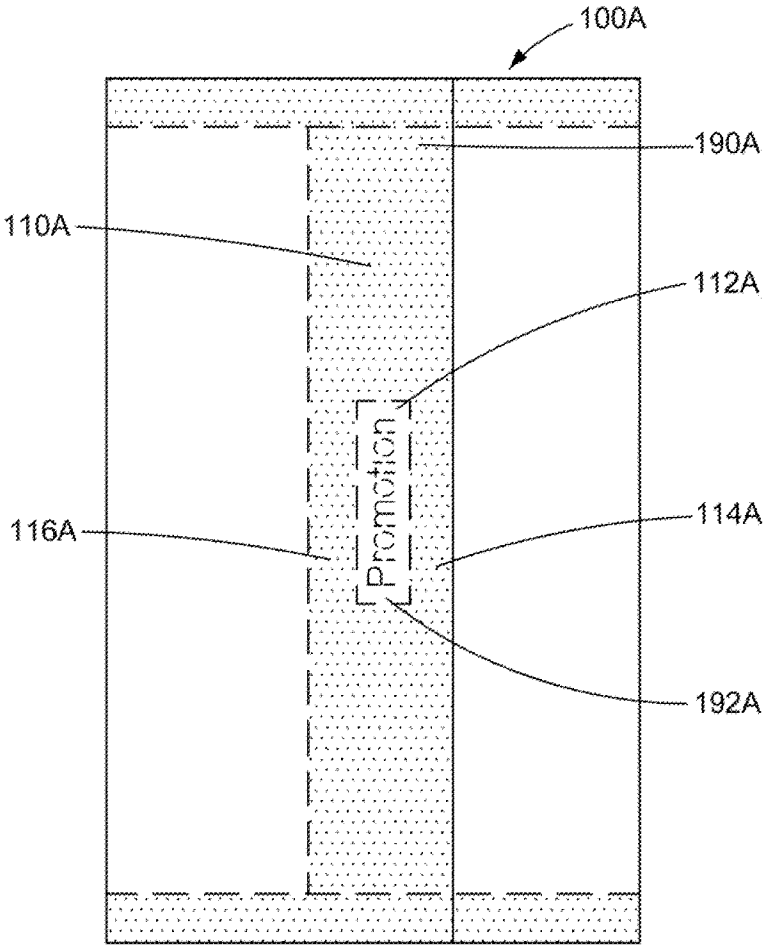
FIG. 6A is a back plan view of the flexible package of FIG. 1 having a lap seal region according to another exemplary embodiment.
Figure 6:
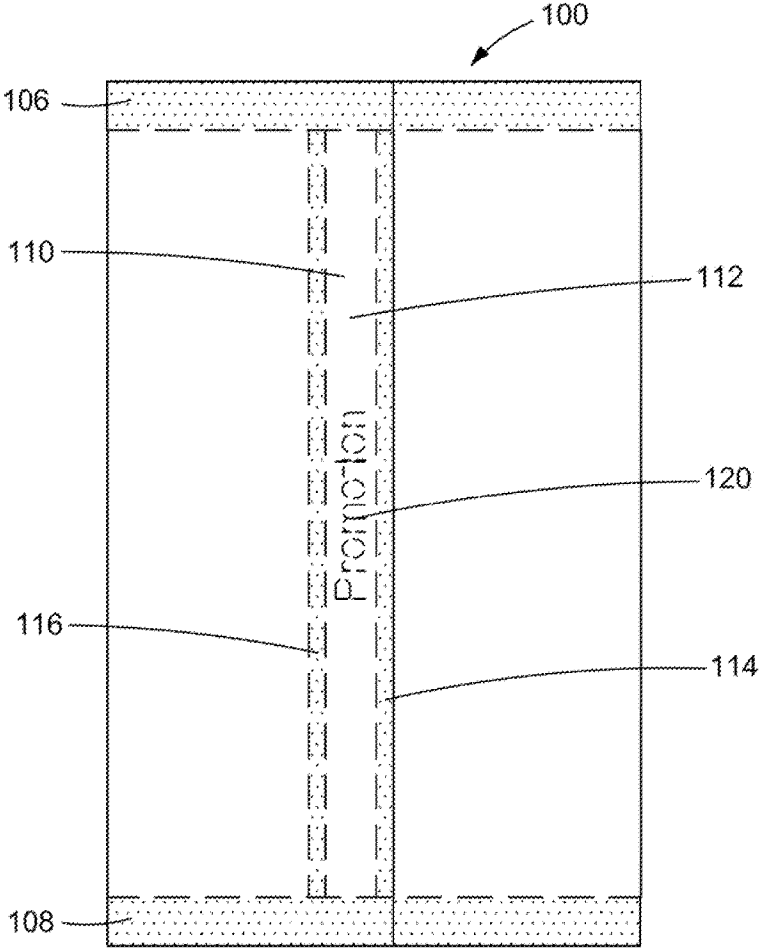
FIG. 6 is a back plan view of the flexible package of FIG. 1 according to an exemplary embodiment.

FIG. 6 shows a plan view of the seal configuration of the flexible package 100 according to an exemplary embodiment. The first seal 114 and the second seal 116 of the seal region 110 are shown as individual (e.g., independent, not interconnected, etc.) seals that are substantially parallel to one another and spaced a distance apart. The distance that the seals 114, 116 are spaced apart generally corresponds to the unsealed area 112 of the seal region 110. According to other exemplary embodiments, however, the seal region has a single seal, the first seal portion and the second seal portion being part of that single seal. FIG. 6A shows a back plan view of exemplary embodiment of a flexible package 100A that is an alternative version of flexible package 100. Flexible package 100A includes a seal region 110A that has a single seal shown as seal 190A. The seal 190A includes first seal portion 114A and second seal portion 116A. An unsealed area 112A of the seal region 110A is shown disposed between the first seal portion 114A and second seal portion 116A, the unsealed area 112A generally corresponding to a void 192A in the seal 190A. The void 192A is shown circumscribed (e.g., surrounded, confined, etc.) by sealed portions of the film. As shown, this seal region provides a longitudinal seal of the package, the longitudinal seal being a back lap seal. As will be discussed later in this disclosure, seal regions (e.g., similar to seal regions 110 and 110A) may provide for seals of the package that are not longitudinal seals. The creation of a seal void can be accomplished by various methods well known in the art (e.g., use of a seal element such as a plate, bar or wheel containing a voided area).

Referring to FIGS. 1-6A, the seal regions 110, 110A are shown as heat seal regions according to an exemplary embodiment. According to other exemplary embodiments, the seal region may comprise any type of seal suitable for providing for the seal regions in accordance with this disclosure. For example, the package may be closed by any suitable glue or adhesive, which is applied in the aforementioned configurations.

According to an exemplary embodiment, there may be multiple concealed graphics panel spaces within a seal region. According to some exemplary embodiments, a seal region may include multiple unsealed areas, wherein at least one unsealed area does not correspond to a concealed graphics panel space.

Figure 7:
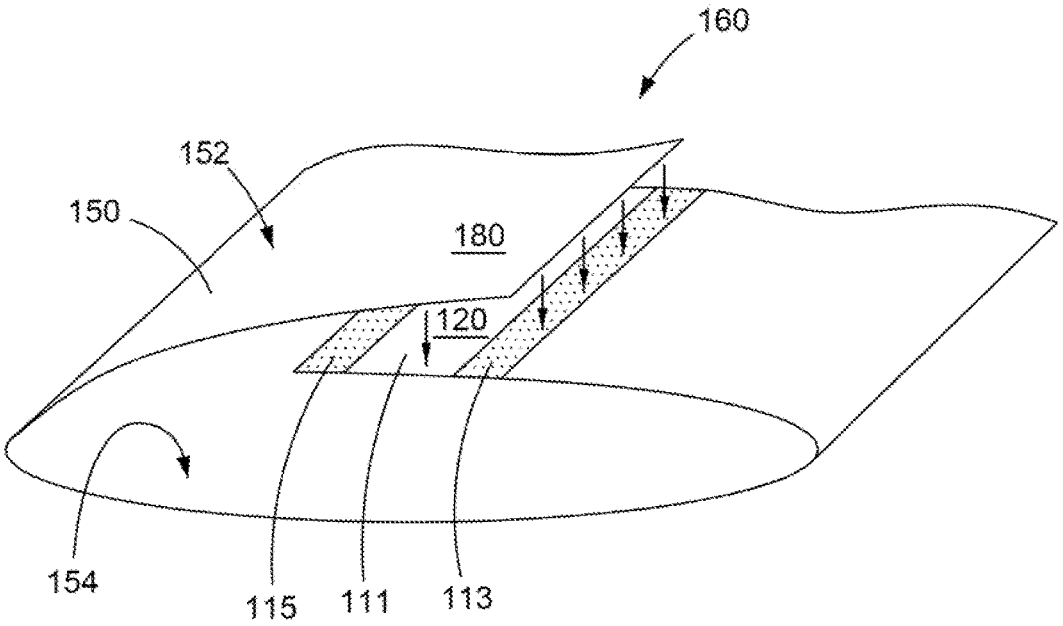
FIG. 7 is partial perspective view of a film to form the flexible package according to the exemplary embodiment of FIG. 1.

FIG. 7 highlights some aspects of formation of the seal region 110 according to an exemplary method of making the package 100. The method of making package 100 generally includes providing the film 150 that has the first side 152 generally opposite the second side 154. The ink layer 170 is applied to the first side 152 of the film 150, the ink layer 170 including an exterior graphics panel 180 and a concealed graphics panel 120. The film 150 is formed into a tube such that a portion of the film 150 overlaps itself to create the overlapped region 160. The seal region is then created, generally corresponding to the overlapped region 160. FIG. 7 shows the seal region not yet fully formed; what will be the locations of the first seal 114 and the second seal 116 are designated as 113 and 115, respectively, to either side of what will be the unsealed area, designated as 111. In the exemplary embodiment shown, the seal region is a heat seal region and the heat seals may be formed according to any method known in the art. For example, the two individual heat seals 114, 116 may be formed by two individual, flat heat seal plates applied substantially simultaneously during a vertical form-fill-seal process. In another example, more than one individual heat seal may be formed by multiple applications of the same heat seal plate. According to another exemplary embodiment where the seal region is a glue, hot-melt adhesive or other adhesive seal region, the glue or adhesive is applied and pressure is used to bond the overlapping portions of the film at the overlapped region. Generally, it is understood that the seal region is formed such that the unsealed area is in register with the concealed graphics panel.

According to an exemplary embodiment, the method of making the package 100 further includes creating (e.g., forming, etc.) the first transverse seal 106 and a second transverse seal 108. In the present exemplary embodiment, the transverse seals are heat seals. Though, according to other exemplary embodiments one or more transverse seals may comprise any type of suitable seal (e.g., glue, hot-melt adhesive or other suitable adhesive; cold seal; etc.).

According to an exemplary embodiment, the film 150 used to make the package 100 is a simple film (i.e., a monolayer film or a film with more than one layer that is not configured to have a preferential separation interface within the layers of the film).

According to other exemplary embodiments, the film may have a more complex structure (e.g., may have a complex layer structure for oxygen and/or moisture barrier, peel, peel-reseal, etc.).

According to an exemplary embodiment, the film 150 used to make the package 100 is a mono layer film.

According to another exemplary embodiment, the film 150 used to make the package 100 is a two layer film.

According to another exemplary embodiment, the film 150 used to make the package 100 is a three layer film.

According to an exemplary embodiment, the film 150 used to make the package 100 is a polypropylene film (e.g., an oriented polypropylene film). According to another exemplary embodiment, the film 150 used to make the package 100 is a polyethylene film. According to an exemplary embodiment, the film 250 includes a foil layer disposed between layers of polymer film.

According to an exemplary embodiment, the film 150 used to make the package 100 is a surface printable high barrier film such as Nylon/tie/Nylon/EVOH/Nylon/tie/PE sealant, wherein the film is coextruded and then direct printed on the nylon side.

According to an exemplary embodiment, the film 150 used to make the package 100 has the following structure PET/ink/adhesive/polyethylene sealant, wherein PET is polyethylene terephthalate or other polyester, the ink layer is a reverse printed, and the adhesive is a laminating adhesive used to bond the polyethylene sealant layer to the reverse printed polyester layer.

It should also be appreciated by a person of ordinary skill in the art that the monolayer or multilayer thermoplastic films in view of the present invention and described hereinabove may be provided by conventional film forming processes which include, but are not limited to, for example, extrusion, coextrusion, single- or double-bubble blown film extrusion, cast extrusion, lamination, coating lamination or similar processes or a combination thereof.

Figure 8:
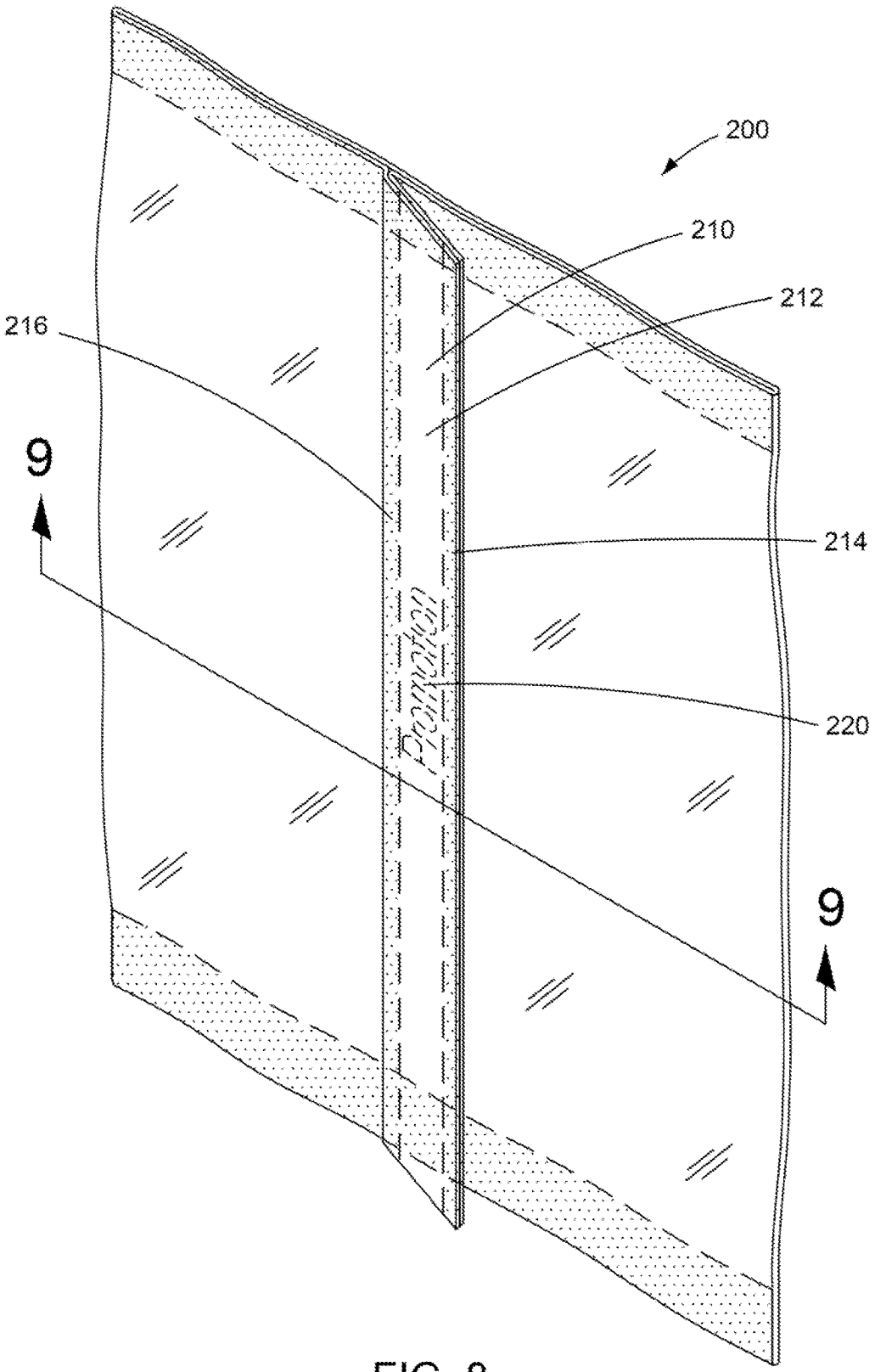
FIG. 8 is a back perspective view of a flexible package including a concealed graphics panel in a closed position according to another exemplary embodiment.
Figure 9:
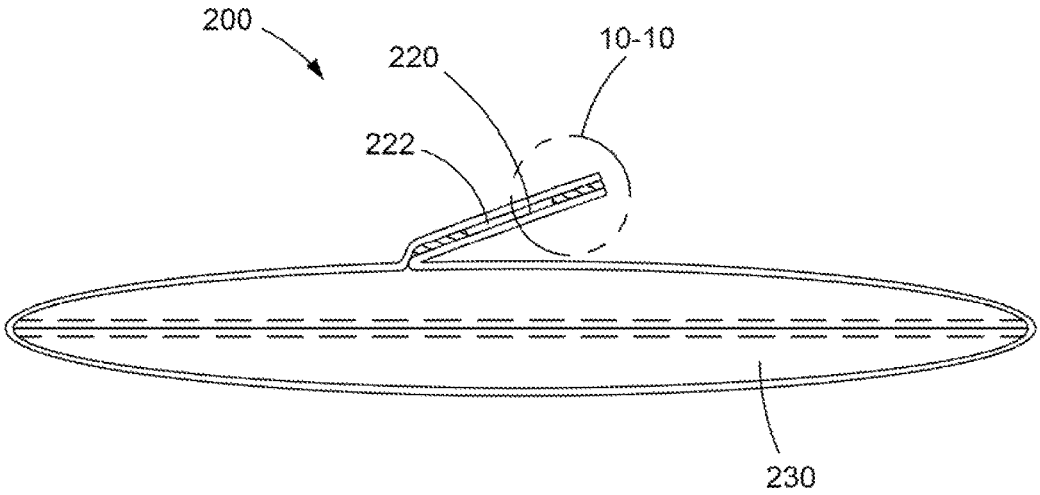
FIG. 9 is a cross-sectional view of the flexible package of FIG. 8 taken along line 9-9.
Figure 10:
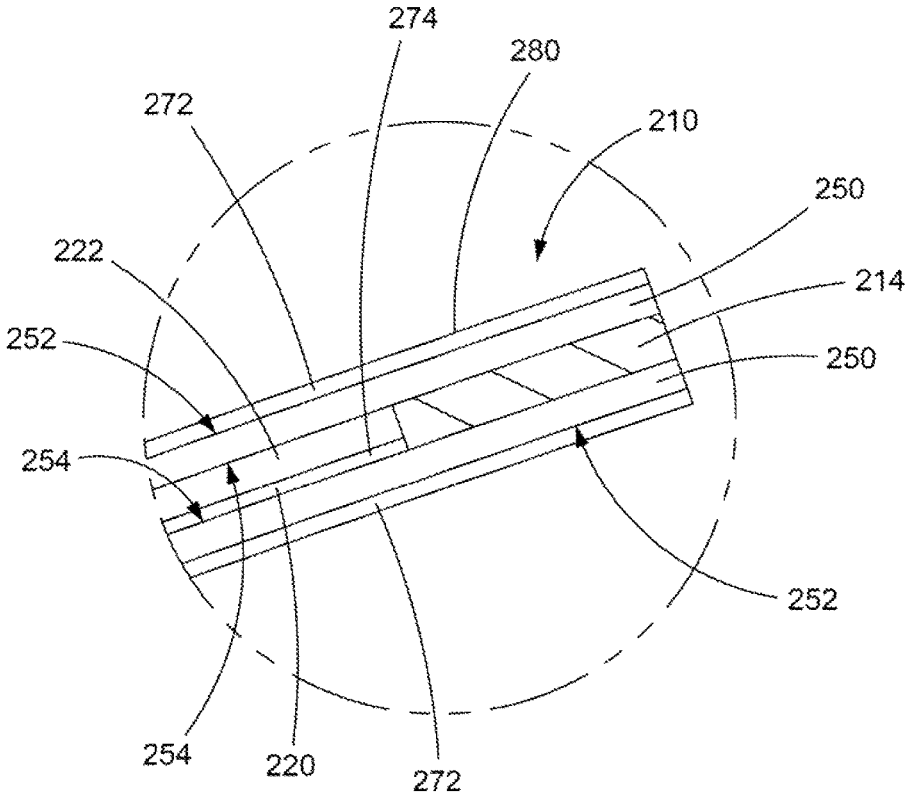
FIG. 10 is a detail view of the cross-sectional view of FIG. 9 taken along line 10-10 according to an exemplary embodiment.

FIGS. 8-10 show a flexible package 200 in a closed position according to an exemplary embodiment. Similar to the flexible package 100 discussed in relation to FIGS. 1-7, the flexible package 200 includes a seal region 210 that is shown as a longitudinal seal and a concealed graphics panel 220. The seal region 210 includes an unsealed area 212 disposed between a first seal portion shown as a first heat seal 214 and a second seal portion shown as a second heat seal 216. The concealed graphics panel 220 is located within the unsealed area 212 of the seal region 210 where it is not visible (e.g., to a consumer) until the flexible package 200 is opened. The configuration of the seal region 210 and related location of the concealed graphics panel 220 provides for a concealed graphics panel space 222 that is separate from the product storage space 230 (see, e.g., FIG. 9).

In contrast to flexible package 100, the seal region 210 of flexible package 200 is a longitudinal seal that is a fin seal. In this exemplary embodiment, the concealed graphics panel 220 is shown disposed on a second side 254 of a film 250 used to form the flexible package 200 while the exterior graphics panel 280 is disposed on an opposing first side 252 of the film 250. The concealed graphics panel 220 faces another portion of the second side 254 of the film 250 when the flexible package 200 is in the closed position; thus, as shown, two portions of the second side 254 of the film 250 are disposed generally adjacent to one another in a concealed graphics panel space 222.

According to an exemplary embodiment, the method of making the package 200 generally includes applying (e.g., direct printing) a first ink layer 272 to the first side 252 of the film 250 to create the exterior graphics panel 280 and applying (e.g., inside printing) a second ink layer 274 to the second side 254 of the film 250 (e.g., opposite or beneath a portion of the exterior graphics panel) to create the concealed graphics panel. The method further includes forming film 250 generally into a tube and sealing opposing edge portions of the film together (e.g., such that the second sides are directly adjacent to one another). In the exemplary embodiment shown, the step of sealing includes forming a heat seal that includes an unsealed portion between a first heat seal portion and a second heat seal portion. According to other exemplary embodiments, the concealed graphics panel and/or the exterior graphics panel may be formed by reverse printing so long as the panel is viewable from the intended vantage point (e.g., the exterior graphics panel is viewable from the outside of the package; the concealed graphics panel viewable as intended (e.g., readable, in the proper orientation) when looking at the second side of the film when the seal region is a fin seal or transverse seal; etc.).

According to an exemplary embodiment, forming the heat seal includes utilizing a heat seal plate, bar or wheel having a void (e.g., opening, recess, etc.) at a location substantially corresponding to the unsealed portion of the resultant heat seal (e.g., the void is generally interior to or centrally located relative to the perimeter or boundaries of the heat seal plate, bar or wheel). According to other exemplary embodiments, multiple heat seal plates, bars or wheels can be used to form a single heat seal having a configuration wherein an unsealed portion is disposed between two heat seal portions within the heat seal region. For example, the heat seal portions created by the multiple heat seal plates, bars or wheels are either contiguous and/or overlapping to collectively form what is functionally a single heat seal. In these cases, the resulting heat seal is desirably in register with the promotional information to create the corresponding unsealed area.

According to other exemplary embodiments, the seal region is a cold seal region. A cold seal adhesive may include substantially any suitable latex adhesives capable of forming dry adhesive layers on polymeric or equivalent film that can later be pressure bonded together, without the use of heat. For example, a suitable cold seal adhesive is disclosed in U.S. Pat. No. 4,810,745, which is hereby incorporated by reference. The cold seal adhesive is applied (e.g., pattern applied by rotogravure printing process or flexographic printing) and pressure is used to bond the overlapping portions of the film at the overlapped region.

Those of skill in the art will appreciate that substantially any conventional process for forming a package including a fin seal can be utilized to make the package 200 or other packages configurations having fin seals including a concealed graphics panel in accordance with the present disclosure.

Figure 11A:
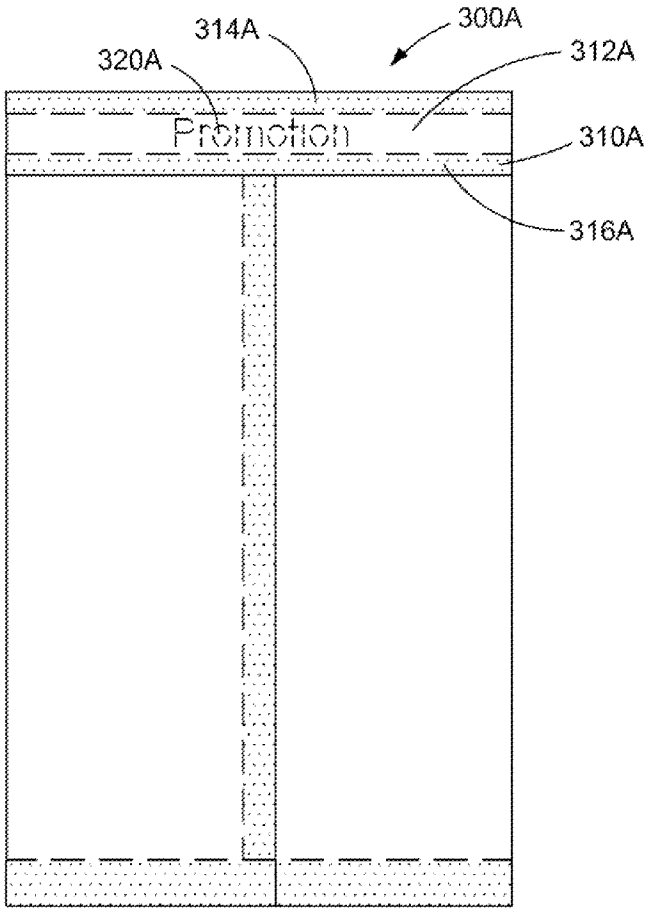
FIG. 11A is a back pan view of a flexible package including a concealed graphics panel in a closed position having a transverse seal region according to another exemplary embodiment.
Figure 11:
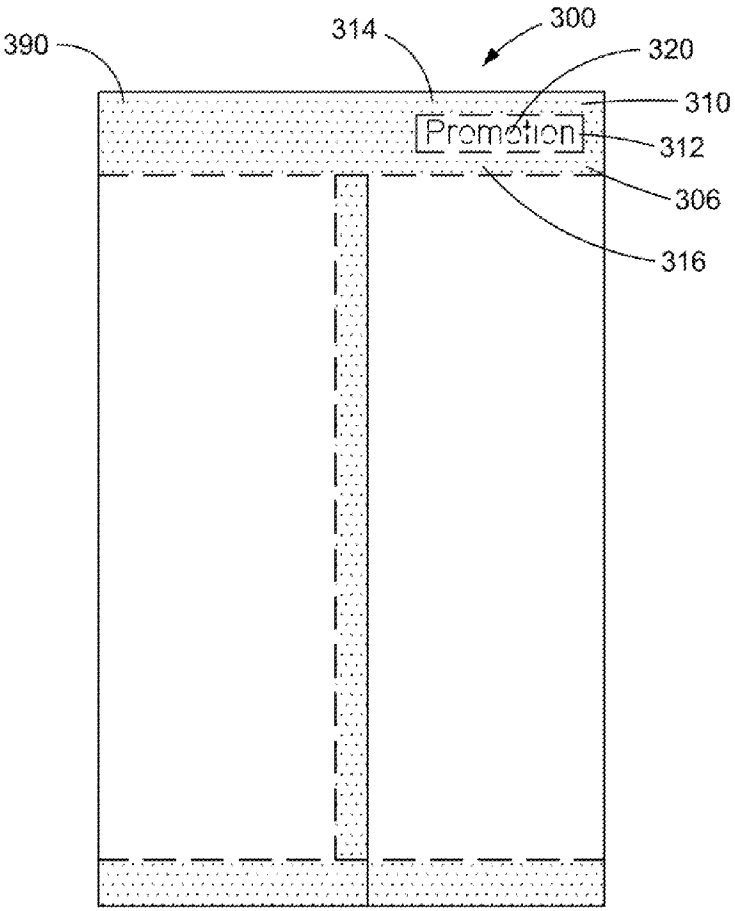
FIG. 11 is a back plan view of a flexible package including a concealed graphics panel in a closed position according to an exemplary embodiment.

FIGS. 11 and 11A show exemplary embodiments wherein the seal region in accordance with the present disclosure is a transverse seal.

Referring to FIG. 11, a rear plan view of a flexible package 300 is shown in a closed position including a seal region 310 that is a transverse seal 306 and a concealed graphics panel 320. The seal region 310 includes an unsealed area 312 disposed between a first seal portion and a second seal portion. The concealed graphics panel 320 is located within the unsealed area 312 of the seal region 310 where it is not visible (e.g., to a consumer) until the flexible package 300 is opened. The configuration of the seal region 310 and related location of the concealed graphics panel 320 provides for a concealed graphics panel space that is separate from the product storage space (not shown, but understood to be substantially similar to exemplary product storage spaces 130 and 230).

Further referring to FIG. 11, the first seal portion is shown as a first seal portion 314 of a single seal 390 and the second seal portion is shown as a second seal portion 316 of the single seal 390. These seal portions 314, 316 are shown located at opposing sides of the unsealed area 312. The concealed graphics panel 320 within the unsealed area 312 is accessed and becomes visible substantially simultaneously with the package 300 being opened (e.g., transitioned from a closed position to an open position). Stated otherwise, breaking the transverse seal 306 generally provides access to both a product storage space as well at a concealed graphics panel space. In the exemplary embodiment shown, the seal region is a cold seal region.

According to another exemplary embodiment, the seal region is a heat seal region.

FIG. 11A shows a back plan view of exemplary embodiment of a flexible package 300A having a seal region 310A that is an alternative version of flexible package 300 according to an exemplary embodiment. The first seal portion is shown as a first seal 314A and the second seal portion is shown as a second seal 316A, the first seal 314A and the second seal 316A being independent of one another (e.g., not interconnected, not contiguous, etc.). The unsealed area 312A generally between the first seal 314A and second seal 316A is shown extending from one side of the package to the other. While a consumer could theoretically look into the unsealed area, it is contemplated that the height of the unsealed area and the position of the concealed graphics panel 320 within the unsealed area 312A will be sized and positioned, respectively, to prevent a party from seeing or clearly viewing the promotional information before opening the package.

According to another exemplary embodiment, two independent seals could taper toward one another (e.g., proximate to the side edges of the package), further inhibiting the ability of a party to view the promotional information in advance of opening.

According to another exemplary embodiment, the transverse seal corresponding to the seal region is at an end of a package not intended to be open (e.g., the bottom end). In such an embodiment, the transverse seal may, for example, be opened after the product is removed (e.g., consumer, placed elsewhere, etc.) to reveal the promotional information.

According to an exemplary embodiment, the film 250 used to make the package 200 or the package 300 has the structure OPP/ink1/polyethylene sealant/ink2, wherein OPP is an oriented polypropylene, the ink layer is reverse printed, the polyethylene sealant is extrusion coated onto the reverse printed OPP film and the second ink layer is direct printed on the second side of the film.

According to an exemplary embodiment, the film 250 used to make the package 200 or the package 300 is a metallized film having the structure OPP/ink1/adhesive/metallized BOPP/ink2/pattern applied cold seal, wherein BOPP is a biaxially oriented polypropylene, ink1 is a first ink layer which is reverse printed onto the BOPP and the adhesive is one that is suitable for lamination of the reverse printed BOPP to the metallized BOPP. The metallized BOPP may either be preprinted or the final multilayer laminate may be inside printed with information that is hidden in the final package. A cold seal adhesive is subsequently pattern applied to the multilayer laminate. According to alternative embodiments, this film structure may be heat sealed, in which case, the pattern applied cold seal layer is not required.

According to an exemplary embodiment, the method of making packages 200 or 300 that are heat sealable packages generally includes applying (e.g., direct printing) a first ink layer to the first side of the film to create the exterior graphics panel and applying (e.g., inside or direct printing) a second ink layer to the second side of the film to create the concealed graphics panel. The method further includes forming the film generally into a tube and creating a longitudinal seal and transverse seals by applying heat and pressure to form a bond.

According to an exemplary embodiment, the method of making packages 200 or 300 that are cold sealable packages generally includes applying (e.g., direct printing) a first ink layer to the first side of the film to create the exterior graphics panel and applying (e.g., inside or direct printing) a second ink layer to the second side of the film to create the concealed graphics panel. The method further includes pattern applying a cold seal adhesive to the package 200 or 300 at locations corresponding to what will be the longitudinal seal and the transverse seals, then applying pressure to form a bond. The unsealed area is created (e.g., formed, etc.) by leaving an adhesive void (i.e., an area where the adhesive is not pattern applied and thus absent). Pattern applying the cold seal adhesive may include rotogravure printing, flexographic printing.

As would be appreciated by one of skill in the art, application of ink as discussed in the present disclosure may be accomplished by methods well known in the art (e.g., rotogravure, flexographic, laser digital, inkjet, etc.). Depending on the application, variable data printing (VDP) technics may be utilized (e.g., for the promotional information of the concealed graphics panel).

As is apparent from the various exemplary embodiments disclosed herein, the concealed graphics panel may be concealed in a number of suitable manners. It should be generally understood that any suitably opaque film layer may be suitable for concealing the concealed graphics panel (e.g., foil, a polymeric layer with low clarity, etc.). It should also be further understood that overlapped ink layers/printing may provide for concealing, such as the exterior graphics panel or an ink layer specifically included to provide a visual barrier (e.g., a white ink layer).

The term "film" is used in the generic to include polymeric web, regardless of whether it is a film or sheet.

As used herein, the terms "polymeric" and "polymer" refers to the product of a polymerization reaction, and is inclusive of homopolymers, copolymers, terpolymers, etc.

As used herein, the term "layer" refers to each of the one or more materials, the same or different, that are secured to one another in the form of a thin sheet or film by any appropriate means such as by an inherent tendency of the materials to adhere to one another, or by inducing the materials to adhere as by a heating, radiative, chemical, or some other appropriate process. The term "layer" is not limited to detectable, discrete materials contacting one another such that a distinct boundary exists between the materials. Preferably, however, the materials used to make one layer of a film will be different (i.e., the weight percent of components, the properties of each component, and/or the identity of the components may differ) from the materials used to make an adjacent, and adhering, layer. The term "layer" includes a finished product having a continuum of materials throughout its thickness.

As used herein, the term "heat seal" refers to the union of a surface (or portion thereof) of one film to a surface (or portion thereof) of another film or two different portions of a surface of the same film using heat and pressure. The heat-seal is achieved by bringing two surfaces or portion of a surface into contact, or at least close proximity, with one another and then applying sufficient heat and pressure to a predetermined area of the two surfaces to cause the contacting surfaces to become molten and intermix with one another, thereby forming an essentially inseparable fusion bond between the two surfaces in the predetermined area when the heat and pressure are removed therefrom and the area is allowed to cool.

As defined herein, the term "cold seal" refers to the union of a surface (or portion thereof) of one film to a surface (or portion thereof) of another film or of two different portions of a surface of the same film by means of a cold seal adhesive material.

As used herein, the phrase "structural weakness" refers to perforations, holes, score lines, laser score lines, tear lines, tear strips, cut patterns, and microperforations in a film structure specifically designed to minimize the digital force required to tear apart a portion of a film or sheet, create a predetermined tear path, remove a portion of the film or open the package.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the flexible packages and heat seal regions as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, many elements (e.g., seal shape, seal type, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A flexible package, comprising:

a film having a first side generally opposite a second side;

a package interior including a product storage space;

an overlapped region of the film;

a longitudinal heat seal region corresponding to the overlapped region of the film;

an unsealed area of the longitudinal heat seal region disposed between a first heat seal of the longitudinal heat seal region and a second heat seal of the longitudinal heat seal region;

an ink layer disposed on the first side of the film, the ink layer including an exterior graphics panel and a concealed graphics panel disposed within the package interior and substantially within the unsealed area of the longitudinal heat seal region.

2. The flexible package of claim 1, wherein the concealed graphics panel is separated from the product storage space.

3. The flexible package of claim 1, wherein the film is a simple film.

4. The flexible package of claim 1, wherein the film includes fewer than three layers.

5. The flexible package of claim 1, wherein the concealed graphics panel faces the second side of the film.

6. The flexible package of claim 1, wherein the first heat seal and the second heat seal are substantially parallel to one another and spaced a distance apart.

7. A flexible package, comprising:

a film having a first side generally opposite a second side;

a package interior including a product storage space;

a seal region including an unsealed area disposed between a first seal portion and a second seal portion;

an exterior graphics panel corresponding to an exterior package surface;

a concealed graphics panel located substantially within the unsealed area of the seal region and separated from the product storage space by either the first or second seal portion; and an ink layer viewable from the first side of the film, the ink layer including the exterior graphics panel and the concealed graphics panel.

8. The flexible package of claim 7, wherein the seal region is a heat seal region having a single heat seal, the single heat seal including the first heat seal portion and the second heat seal portion and further including a void.

9. The flexible package of claim 7, wherein the seal region is a cold seal region.

10. The flexible package of claim 7, wherein the first seal portion is a first heat seal and the second seal portion is a second heat seal.

11. The flexible package of claim 7, wherein the seal region is a fin seal region.

12. The flexible package of claim 7, wherein the seal region is a transverse seal region.

13. A method of making a flexible package having a concealed graphics panel, the method comprising:

providing a film having a first side generally opposite a second side;

applying an ink layer to the film, the ink layer including a concealed graphics panel and an exterior graphics panel;

forming the film into a tube;

creating a product interior including a product storage space;

creating a seal region, wherein the seal region includes an unsealed area disposed between a first seal portion and a second seal portion;

locating the exterior graphics panel such that it corresponds with the exterior package surface; and locating the concealed graphics panel substantially within the unsealed area of the seal region; and such that the concealed graphics panel is separated from the product storage space by either the first or second seal portion.

14. The method of making a flexible package having a concealed graphics panel of claim 13, wherein the concealed graphics panel is disposed interior to the tube within an overlapped region when the film is formed into a tube.

15. The method of making a flexible package having a concealed graphics panel of claim 13, wherein creating a seal region includes defining the unsealed area by forming the first seal portion and the second seal portion spaced a distance apart.

16. The method of making a flexible package having a concealed graphics panel of claim 13, wherein creating a seal region includes defining the unsealed area with a heat sealing element including a void that is entirely within the perimeter of the seal region.

17. The method of making a flexible package having a concealed graphics panel of claim 13, wherein creating a seal region includes forming a single heat seal including both the first heat seal portion and the second heat seal portion.

18. The method of making a flexible package having a concealed graphics panel of claim 13, wherein the second side of the film is positioned generally corresponding to the package interior and the concealed graphics panel is disposed on the second side of the film.

* * * * *